United States Patent [19]

Abraham et al.

[11] 4,269,162

[45] May 26, 1981

[54] SPRING TYPE BALL PITCHING APPARATUS

[76] Inventors: Jeffrey L. Abraham, 218 Maplewood, San Antonio, Tex. 78216; Gary D. Banse, 546 Gilbert, San Antonio, Tex. 78213

[21] Appl. No.: 869,704

[22] Filed: Jan. 16, 1978

[51] Int. Cl.[3] ..... F41B 7/00

[52] U.S. Cl. ..... 124/7; 273/26 D; 124/50; 124/41 R; 221/200

[58] Field of Search ..... 124/7, 36, 41 R, 49, 124/50; 273/26 D

[56] References Cited

U.S. PATENT DOCUMENTS

| | | | |
|---|---|---|---|
| 2,815,743 | 12/1957 | Brunderman | 124/50 X |
| 3,213,843 | 10/1965 | Laney | 124/7 |
| 3,262,439 | 7/1966 | Johns | 124/50 X |
| 3,470,859 | 10/1969 | Ponza | 124/36 X |
| 3,511,225 | 5/1970 | Yokoi | 124/7 |
| 3,601,111 | 8/1971 | Embray | 124/7 |

*Primary Examiner*—William R. Browne

*Attorney, Agent, or Firm*—Cox & Smith Incorporated

[57] ABSTRACT

A ball pitching machine having a spring powered pitching arm and having a dispensing mechanism with a de-jammer device for individually dispensing balls from a supply hopper and a ball loading device for automatically positioning a ball on the pitching arm for each cycle of the apparatus. A torsion adjusting mechanism is used to set the torsion of the coil spring to a prestressed first predetermined force value. The pitching arm applies an additional torsioning force to the coil spring resulting in a second greater predetermined stored force value in the coil spring. An adjustable link extends directly between and connects the coil spring to the pitching arm to maintain the amount of torsion in the coil spring at the first prestressed first determined force value.

4 Claims, 18 Drawing Figures

SPRING TYPE BALL PITCHING APPARATUS

BACKGROUND OF THE INVENTION

This invention relates generally to devices for automatically pitching balls for batting practice and particularly of the softball pitching type. More specifically, the invention is directed to a machine having an automatic feeding mechanism to allow the machine to sequentially pitch balls for batting practice or the like.

Ball pitching machines are well known in the prior art. Examples of some ball pitching machines are found in U.S. Pat. Nos. 1,152,186; 1,223,386; 1,825,882; 2,080,958; 2,082,818; 3,760,787; and 3,788,297. There is also known a baseball pitching device which uses two rotating wheels between which a ball is fed to be engaged by the wheel for projection.

As far as is known, the prior art devices have suffered from disadvantages which may prevent their utilization in commercial applications. Ball pitching machines typically may be used outdoors, which requires that the device be resistant or immune to exposure to weather conditions during periods of non-use. The size of ball pitching machines may make it inconvenient to keep the machines covered at all times, which may expose the machines to rain.

In order to be commercially feasible, the ball pitching machines should be reliable and be capable of repeatedly pitching balls with a minimal amount of attention from an operator. This requires a reliable feeding and loading mechanism to sequentially position the balls on a pitching arm. When balls are dumped into a hopper supply means, the balls tend to jam at the outlet and may not be individually discharged unless de-jammed. Also, the balls must be accurately dispensed each cycle of the machine. The use of gravity may not always be suitable for such an application, particularly when a large number of balls is made available in a storage bin for dispensing to the pitching arm.

SUMMARY OF THE INVENTION

A new and improved ball pitching apparatus, particularly for pitching softballs, having a spring powered, oscillating pitching arm which sequentially pitches balls at a predetermined rate to a batter. A dispensing basket or storage bin is provided on the apparatus for holding a large number of balls, so that the apparatus will provide repeated pitches to a batter. The dispensing basket includes a de-jammer mechanism which de-jams balls from the outlet of the basket to maintain a constant supply of balls to the pitching arm. A ball positioning or loading means is also provided to accurately dispense a single ball to a ball holder on the pitching arm for each cycle of the apparatus.

BRIEF DESCRIPTION OF THE PREFERRED EMBODIMENTS

Figure 1:
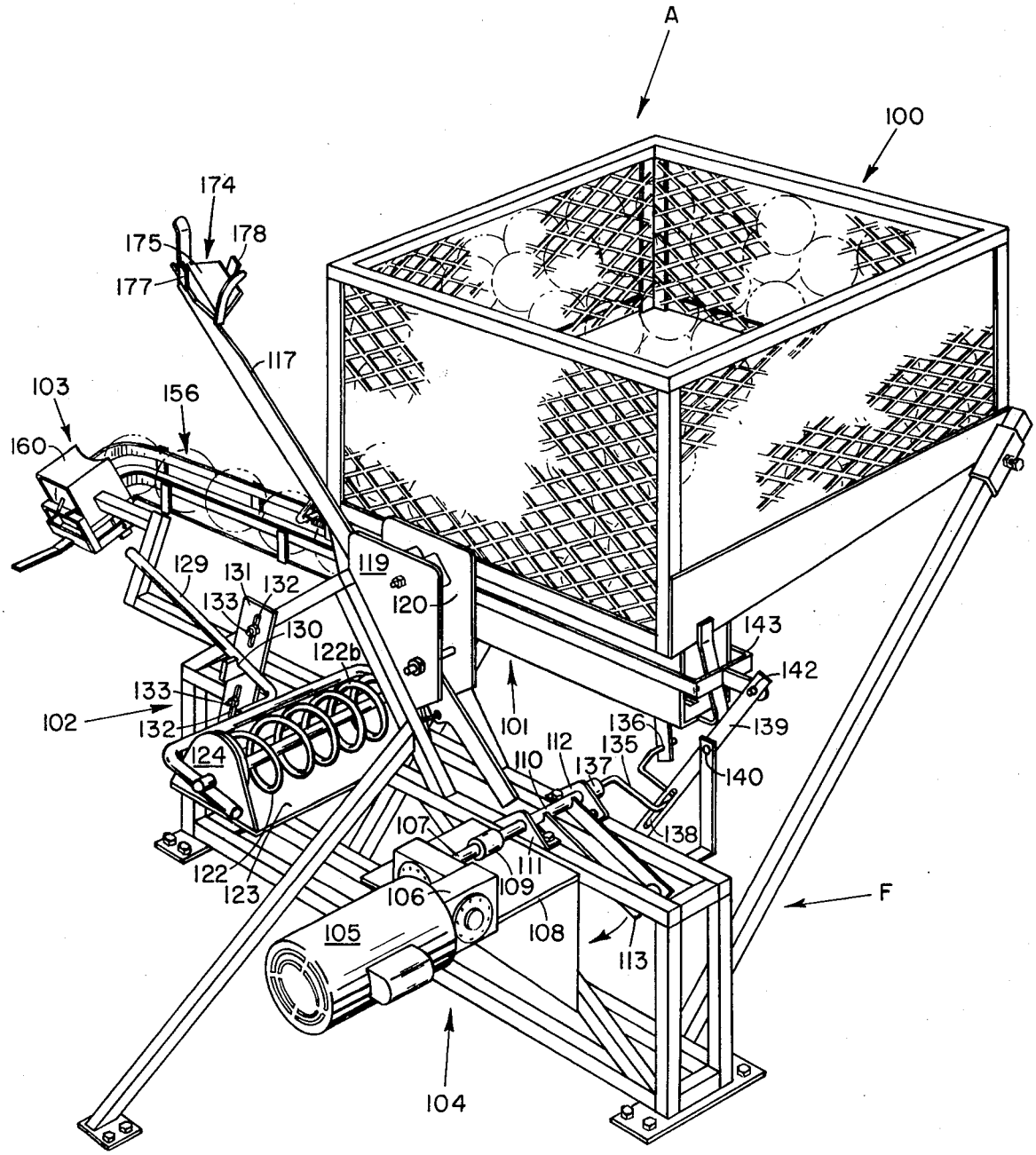
FIG. 1 is a perspective view of the pitching apparatus showing a preferred embodiment of this invention.

Turning now to the drawings there is shown a ball pitching apparatus A in accordance with the invention. The apparatus A includes a ball holding basket generally designated by the numeral 100. The ball holding basket or hopper 100 includes a ball feeding apparatus including a de-jammer mechanism, designated generally by the numeral 101. The apparatus further includes a ball pitching means 102. The apparatus A further includes a ball loading apparatus including a ball loading mechanism 103 which delivers a single ball from the ball de-jammer mechanism to the ball pitching arm during each sequence of operation of the machine. A drive means 104 is provided to cock and release the pitching arm and also to operate the ball de-jammer mechanism for each cycle of the machine. The apparatus A includes a frame S which supports the components of the apparatus and which is preferably mounted on a suitable support which may be permanent or portable.

The apparatus generally operates as follows. A plurality of balls are dispensed from the ball holding basket 100 by the ball de-jammer mechanism 102 for supplying to the ball loading mechanism 103. The drive means 104 cocks the ball pitching means 102 which includes a pitching arm. The pitching arm engages the ball loading mechanism 103 to supply a single ball to the pitching arm. The drive means 104 cocks the pitching arm for each cycle of the machine and also at the same time operates the ball de-jammer mechanism to maintain a supply of balls to the ball positioning mechanism 103.

The drive means 104 includes a suitable motor 105 which typically may be electric. The motor 105 is coupled to a reduction gear unit 106 which includes a rotating output shaft 107. The motor 105 is connected with suitable circuits for activation of the motor and may also include suitable means for varying or otherwise controlling the rotating speed of the motor which determines the cyclical time for the apparatus. The reduction gear box 106 is of conventional sealed construction and the gear reduction is matched to the output speed of the motor to provide the proper speed for the rotating output shaft 107. The motor and gear box are mounted on a suitable frame member 108.

Figure 12:
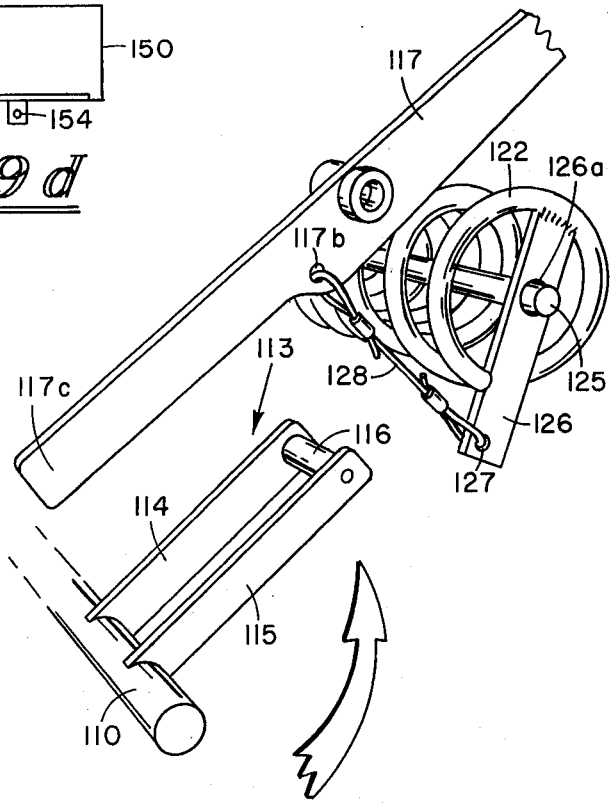
FIG. 12 is a partial view depicting the spring mechanism which powers the pitching arm.

A conventional coupling 109 is provided for connecting the output shaft to the main drive shaft 110 of the apparatus. The main drive shaft 110 is mounted for rotation in journals 111 and 112 which are secured to the frame F by suitable means such as bolts. Suitable bearings may be provided in the journals 111 for rotating of the drive shaft therewith. Rigidly secured with the drive shaft 110 is a cocking means 113 which comprises two straps 114 and 115, as best shown in FIG. 12 and a friction reducing roller 116 mounted for rotation at the ends of the straps 114 and 115. As will be apparent, rotation of the drive shaft 110 through the motor 105 and gear box 106 will also cause the cocking means 113 to rotate, as indicated by the arrow in FIG. 1 and FIG. 12.

Figure 2:
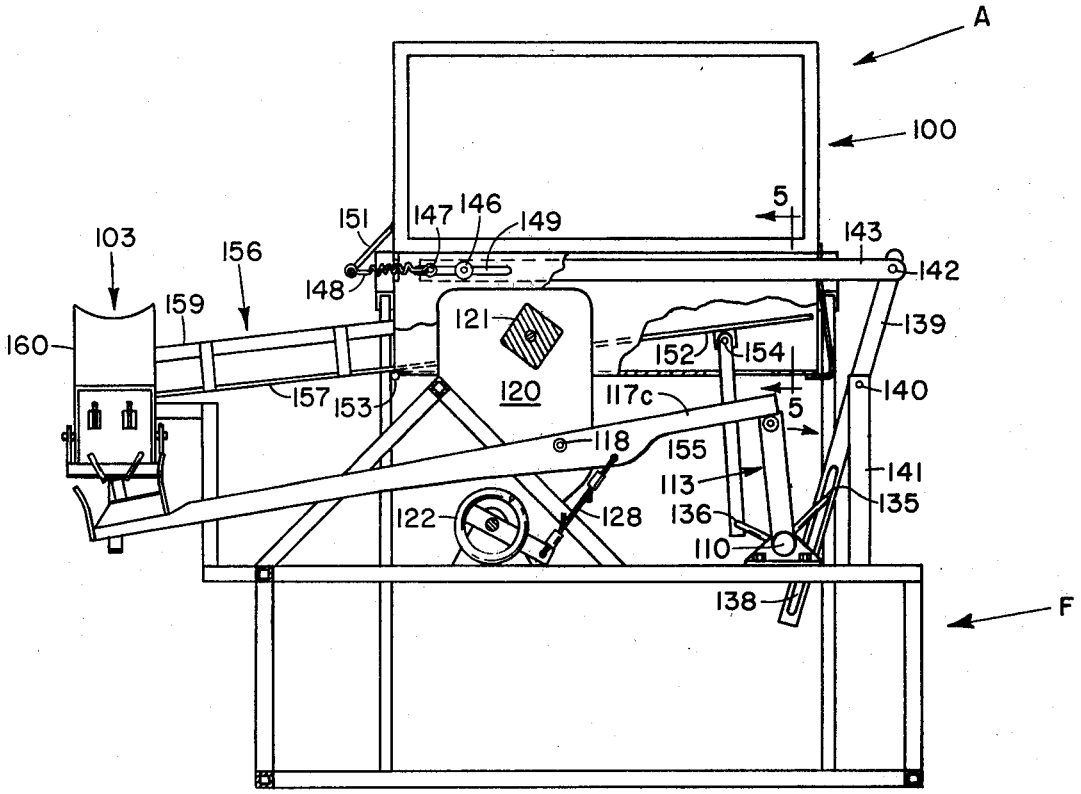
FIG. 2 is a side view of the apparatus, partially in section, with portions deleted, showing the details of the pitching arm.
Figure 4:
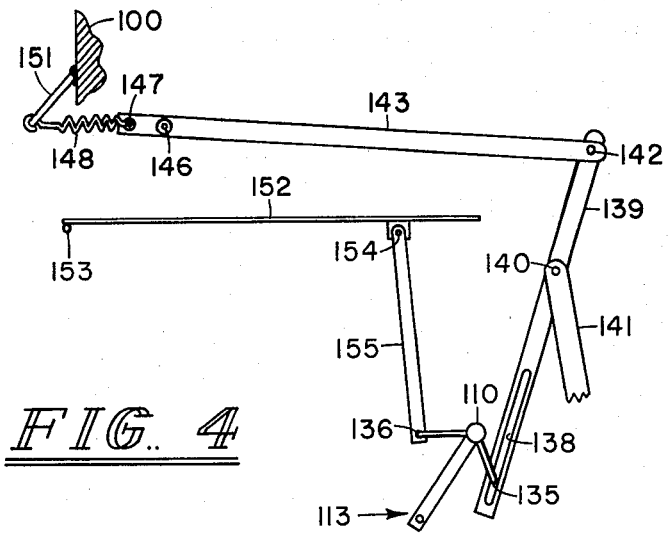
FIG. 4 is an additional partial view of the de-jammer mechanism of the apparatus during another phase of operation of the apparatus.
Figure 14:
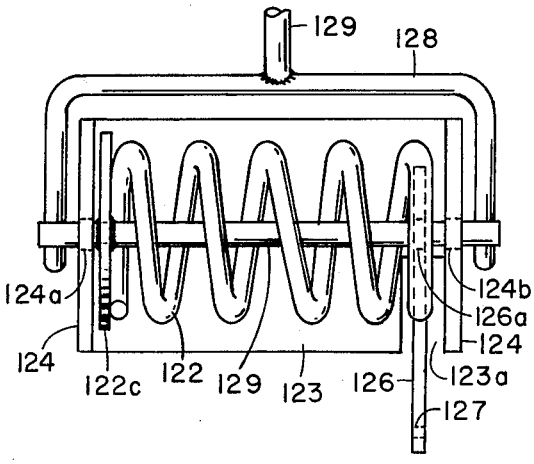

The ball pitching means 102 includes a pitching arm 117 as shown in FIGS. 1 and 2 which is mounted for rotation on shaft 118. The shaft 118 is mounted between the parallel plates 119 and 120, as shown in FIG. 1. The plates 119 and 120 are rigidly secured to the frame F. Also mounted between the plates 119 and 120 is a bumper block 121, which may be made out of rubber or other suitable resilient material which is capable of absorbing a blow from the arm 117 during each cycle of the machine. The location of the block 121 affects the arc of the ball thrown from the pitching arm. The lower end 117C of the pitching arm is adapted to engage the roller 116 as best shown in FIG. 2 with the pitching arm fully cocked just prior to release. During the rest position of the arm 117, the bumper block 121 may be engaged. A coil spring 122 is provided to supply power to the arm. This coil spring 122 is mounted in a support bracket 123 as best shown in FIG. 14, which is secured to the frame F. The support bracket 123 is generally C-shaped, as best shown in FIGS. 1 and 4 and includes ears 124 at each side thereof. A shaft 125 is provided extending through the center of the spring, with the shaft 125 mounted for rotation relative to the apertures **124*a* and 124*b* in the ears. At one end of the spring 122, as best shown in FIG. 12, a strap 126 is provided with one end of the strap 126 secured to the spring by suitable means such as welding. The strap 126 includes an aperture 126*a* for rotatably receiving shaft 125 and aperture 127 at its end farthest from the spring. Slot 123*a* is provided for rotation of strap 126 so the strap 126 will not engage the bracket 123. A cable 128 of predetermined length is provided to connect the strap 126 with the arm 117. As best shown in FIG. 2, the cable means 128 extend through an aperture 127 and the strap 126, and an additional aperture 117B in the arm 117**. The cable provides some adjustment of the throwing power of the pitching arm and a rigid strap could be substituted for the cable.

The shaft 125 is free to rotate relative to the right-hand portion of the spring 122, due to aperture **126*a*. However, the lefthand portion of the spring 122B is rigidly secured for rotation with the rod 125 by a suitable means such as a disc 122*c* welded to the end of the spring or a strap connected to the spring and rigidly secured to the rod 125, by suitable means such as welding. Secured to opposite ends of the shaft 125 is U-shaped member 128 which further includes an extension lever arm 129 secured therewith. The lever arm 129 rests in a notch 130 in a tension adjusting bracket 131. The torsion adjusting bracket 131 includes a plurality of elongated slots 132 which receive bolts 133 which adjustably secure the torsion adjusting bracket 132 to the frame F. The outer end of the extension 129 is adapted to be grasped by hand for rotation of the rod 125. As will be apparent, rotation of the rod 125 will torsion the spring 122 since the engagement of the strap 126 with the support bracket 123 prevents rotation of the spring at one end. However, the spring 122 is rigidly connected at 122B with the rod 125 through disc 122*c*, so that rotation of the shaft 125 will adjust the torsion of the coil spring 122. In other words, the shaft 125, as shown in FIG. 12, is rotatably inserted through an opening 126*a* in the strap 126 while the shaft 125 is rigidly connected to the other end through disc 122*c***.

Rotation of the cocking means 113 causes the roller 116 to rollably engage the end **117*c* which will cause the arm 117 to rotate to the position shown in FIG. 2. In this position, the cable 128, which is connected between the arm and the the strap 126 has caused the strap 126 to rotate against the forces of the spring to store a predetermined amount of energy in the spring. When the cocking means 113 reaches the position as shown in FIG. 2, the arm 117 will be in a fully cocked position with the maximum torsion in the spring 122. As will be apparent, further rotation of the cocking means 113 will engage the roller 116 with the lower end 117*c* of the pitching arm, which will cause the pitching arm to rotate until it engages the bumper block 121**. The pitching arm is particularly designed for slow pitch softball in that it throws a ball at a predetermined arc as desired.

Figure 3:
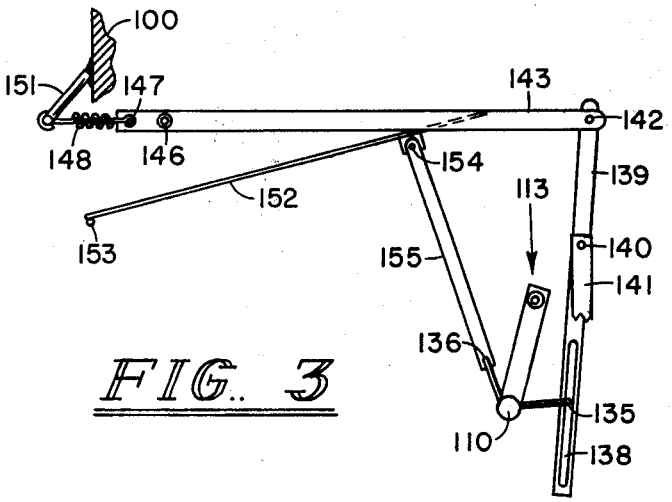
FIG. 3 is a partial view of the de-jammer mechanism for the basket.
Figure 5:
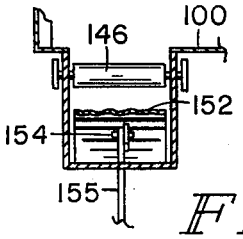
FIG. 5 is a broken cross-sectional partial view taken along line 5—5 of FIG. 2.
Figure 6:
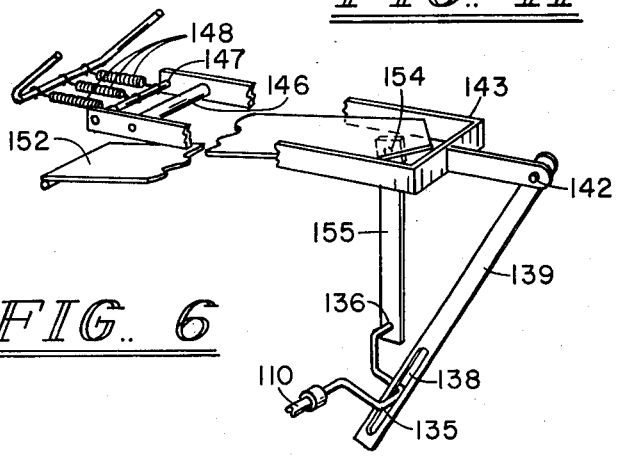
FIG. 6 is an additional partial view of the de-jammer mechanism of the apparatus.
Figure 7:
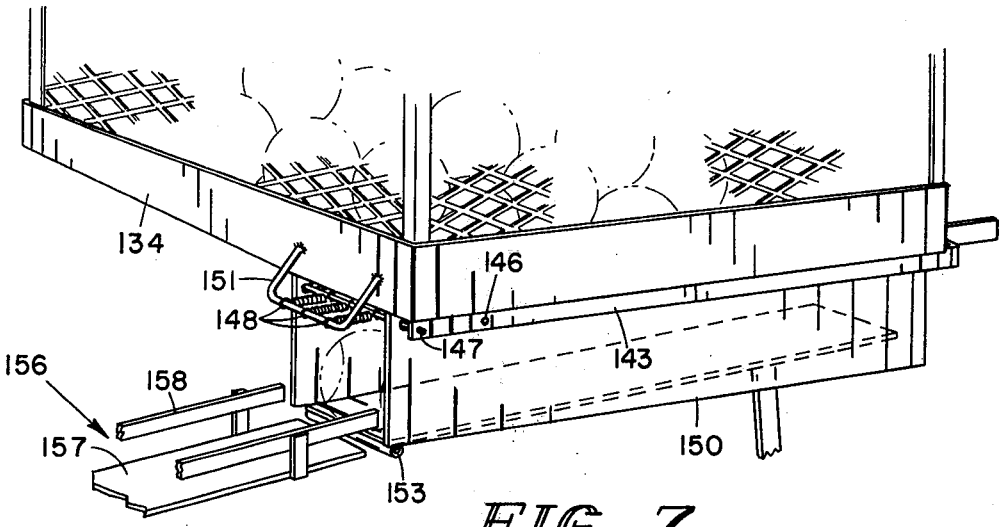
FIG. 7 is another partial view of the de-jammer apparatus with a partial view of the basket for holding the balls.

Ball holding basket 100 includes a sloped floor 134 for supplying balls to the ball de-jammer mechanism 101. The floor 134 of the ball holding basket 100 does not extend over the ball de-jammer mechanism so that balls will flow by gravity into the de-jammer mechanism. The drive for the de-jammer mechanism as shown in FIG. 1, includes a crank means having a first crank arm 135 and a second crank arm 136. The crank arms 135 and 136 are connected by a suitable coupling 137 to the main drive shaft 110. Accordingly, rotation of the main drive shaft 110 will also rotate the cranks 135 and 136. The crank 135 as shown in FIGS. 1 and 2, extends through a slot 138 in oscillating arm 139. The arm 139 is mounted for rotation about a pivot pin 140 on upstanding bracket 141 which is secured to the frame F. A portion of the ball de-jammer mechanism is rotatably secured by a pin 142 at the upper end of the arm 139. The pin 142 is connected to a bifurcated member 143 which forms a part of the de-jammer mechanism. The shape of the bifurcated member 143 is best shown in FIG. 6 of the drawings. The bifurcated member 143 extends along the open portion of the floor of basket 100 and is mounted for reciprocation with the basket 100. At the open end of the bifurcated member 143 is a ball de-jammer including a roller 146 which is mounted for rotation relative to the member 143. A fixed member might be substituted for the roller, although the rotation of the roller upon engagement with the ball is desired to avoid damage to the balls. A cross bar 147 is also provided for connection to a plurality of springs 148. Slots 149 (only one of which is shown) are provided in the de-jammer delivery trough 150 for receiving the roller 146 and pin 147 to allow the member 143 to reciprocate. The springs 148 are attached to a bracket member 151 which is secured to the basket as best shown in FIGS. 3, 4 and 7. Springs 148 block the passage of balls between the pin 147 and the basket to prevent jamming of the outlet of the trough 150 so that balls will be freely dispensed. A sliding panel in a slot in the basket or other suitable means could be substituted for the springs.

The de-jammer mechanism further includes a pivoted floor member 152, pivotally mounted at 153 to the ball delivery trough 150. The plate 152 is pivotally connected through pin 154 to an arm 155, which extends through a slot (not shown) in the trough and which includes an aperture through which the crank member 136 extends. Accordingly, rotation of the crank member 136 will cause the floor member 152 to oscillate or tilt about the pin 153, as best shown in FIGS. 9A, 9B, 9C and 9D. A guide channel means 156 is provided to receive balls from the ball delivery mechanism and gravity feeds the balls to the ball positioning mechanism 103.

Figure 9A:
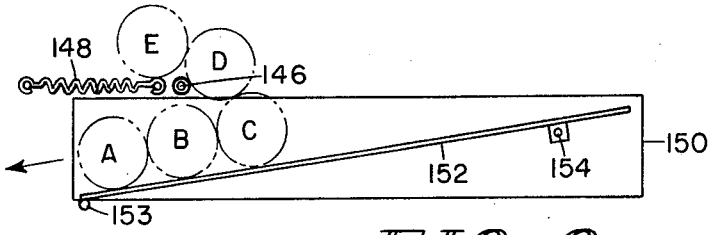
FIGS. 9A, 9B, 9C and 9D are partial schematic views depicting the sequence of operations involved in dispensing a ball from the basket with the de-jammer mechanism.
Figure 9B:
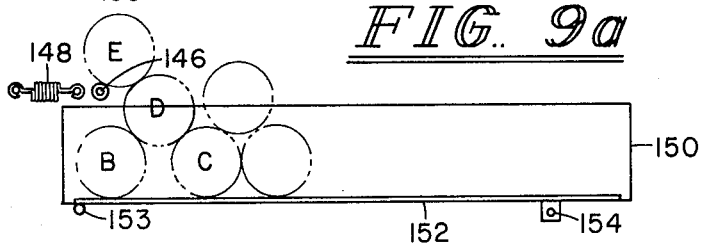
Figure 9C:
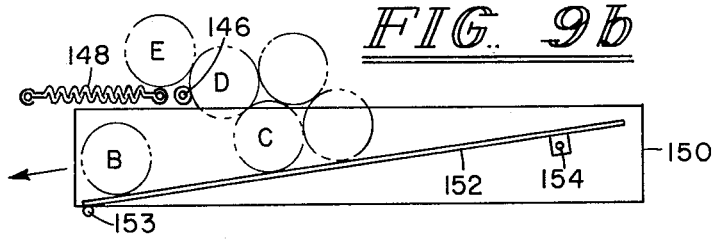
Figure 9D:
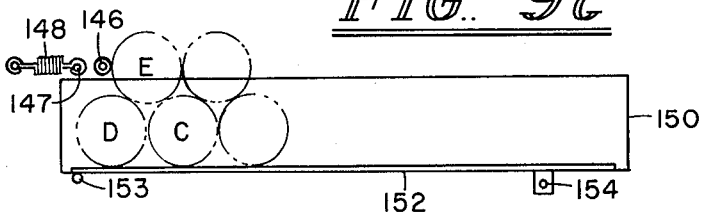

The operation of the ball de-jammer mechanism is best depicted in FIGS. 9A through 9D. Rotation of the drive shaft 110 will in turn cause the cranks 135 and 136 to rotate which will pivot the arm 139 about the pin 140 and cause the arm 155 to reciprocate to pivot the floor 152 about the pin 153. In other words, the floor 152 will be raised at its right end, as shown in FIG. 9A, to form an incline plane to cause the balls to roll down it. FIGS. 9A and 9B depict one complete cycle of the ball de-jammer mechanism and FIGS. 9C and 9D depict another complete cycle. Rotation of the crank 135 will cause the roller 146 to move to the right as shown in FIG. 9A, so that the balls depicted as E and D will not be resting on the balls A and B, so that the balls A and B are free to roll out of the ball delivery trough 150 into the channel 156. Springs 148 prevent any balls from falling down against the balls A or B which might prevent the balls from being discharged out the delivery trough 150. During the rest position, the floor 152 is substantially horizontal, so that substantially no gravity forces are provided against the ball B to cause it to roll into the channel 156. During a second cycle of the apparatus, the floor 152 will be inclined again, as shown in FIG. 9C and the roller 146 will engage the ball D, which in turn engages the ball C so that no balls will be resting on the ball D, so that it may freely roll into the channel 156. Movement of the roller 146 to the left, as shown in FIG. 9D, will allow the balls to assume the rest position with the floor 152 again substantially horizontal so that substantially no gravity forces are applied to the balls to force them out the channel. The above process is repeated for each cycle of the machine, so that balls will be delivered into the inclined channel 156 without jamming up in the basket 101 to continuously supply balls to the pitching arm 117.

As balls are dispensed from the basket 100, they roll down the inclined channel 156 which includes a bottom member 156 and side rails 158 and 159. As shown in FIG. 1, a plurality of balls roll along the channel 156 from the basket 100 to be delivered to the ball positioning mechanism 103.

Figure 10:
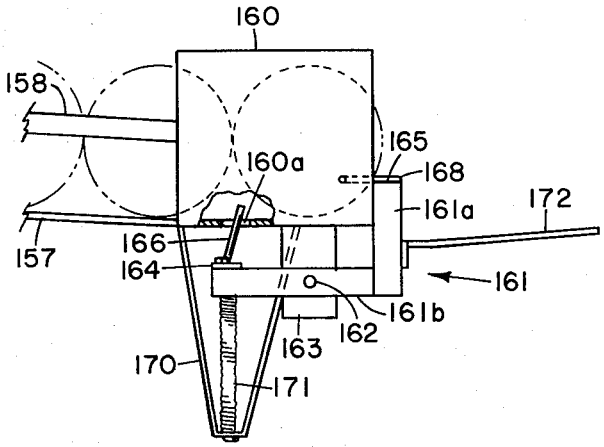
FIG. 10 is a partial view of the loading mechanism for positioning the ball on the throwing arm.
Figure 11:
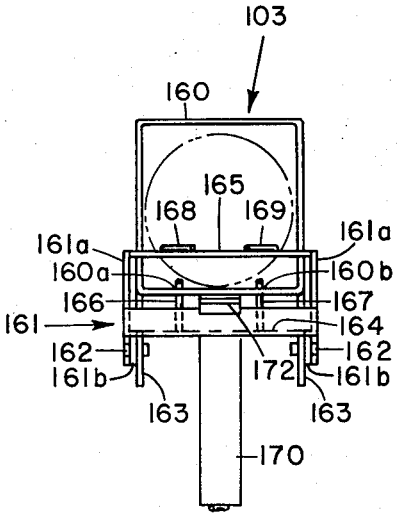
FIG. 11 is another partial view of the loading mechanism for positioning a ball on the throwing arm.

The ball loading mechanism 103 (FIGS. 10–11) includes an enclosed channel member 160 which forms a continued pathway with the channel 156 through which the balls roll. It is understood that the mechanism 103 is tilted, as shown in FIGS. 10–11, although it is shown as level in FIGS. 10–11 for clarity. As best shown in FIG. 10, ball positioning mechanism 103 includes a loading member 161 which is attached to pivot pins 162 through lower extending brackets 163, which bracket is secured to the enclosed channel member 160.

As best shown in FIG. 11, two brackets 163 extend downwardly from the enclosed channel member 160 for pivotally mounting the loading member 161 on pins 162. The member 161 includes two perpendicular legs **161*a* and 161*b* with a cross member 164 connecting the ends of the legs 161*b* and an additional cross or connecting member 165, connecting the ends of the legs 161*a*. A channel blocking means including prong members 166 and 167 extend upwardly from the cross or connecting member 164 as shown in FIGS. 10 and 11 to engage a ball within the enclosed channel member 160. As will be apparent, upon rotation of the member 161 about the pivot pins 162 the prongs 166 and 167 will be raised upwardly through openings 160*a* and 160*b* in the lower base portion of the enclosed channel member to engage a ball within the channel member and to block balls within the channel 156 from entering the channel member 160. A ball retaining means including two additional prongs 168 and 169 are provided to prevent rolling of a ball out of the channel member until the member 161 is pivoted about the pin 162. A V-shaped bracket 170 is provided attached to the lower base portion of the channel member 160 for mounting a spring 171 which is secured to the V of the V-shaped bracket 170 and to the cross member 164. Accordingly, the spring 171 will bias the legs 161*a* of the L-shaped member 161 until they engage the right hand end as viewed from FIG. 10 of the channel member 160. Arm engaging member 172 is provided to be engaged by the pitching arm 171, as best shown in FIG. 2. Upon cocking of the pitching arm, whose position is shown in FIG. 2, the pitching arm 117 will engage the member 172 to cause the L-shaped member 161 to rotate about the pins 162 and load a ball which is positioned in the channel member 160 into the ball port member 173, which is best shown in detail in FIGS. 13A and 13B**.

Figure 13A:
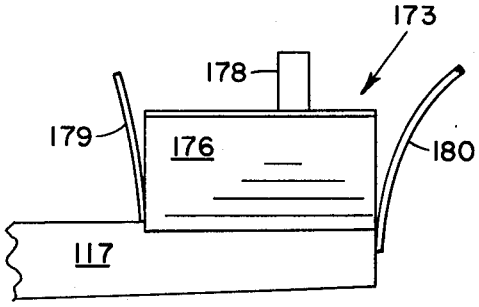
FIG. 13A depicts the ball throwing portion of the pitching arm.
Figure 8:
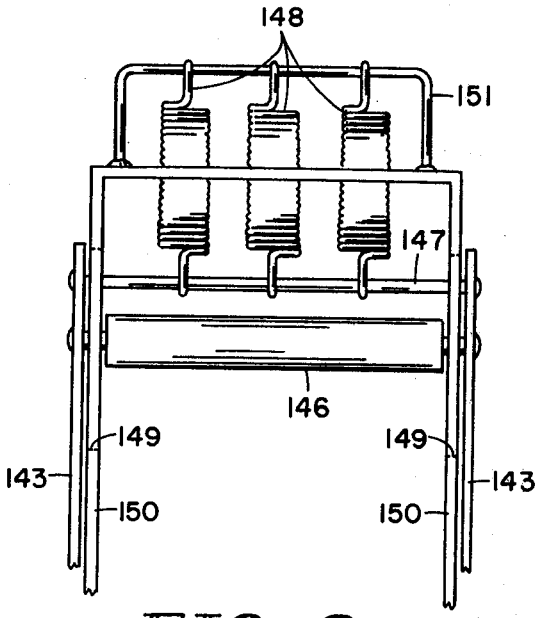
FIG. 8 is a partial view of the de-jammer mechanism of the apparatus.
Figure 13B:
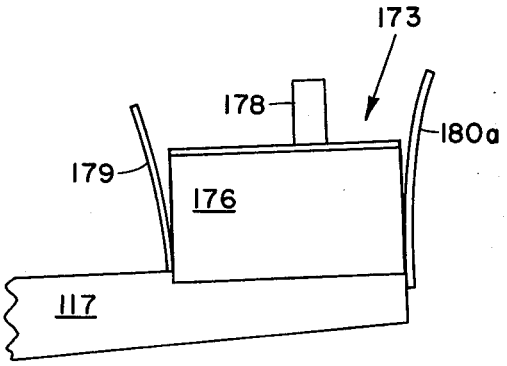
FIG. 13B depicts a modified version of the ball throwing portion of the pitching arm.

The ball support means 173 includes a V-shaped cradle member 174 which is made of plates 175 and **176*c* which are secured to the pitching arm 117 by suitable means such as welding. Side tabs 177 and 178 are provided to retain a ball within the V-shaped support 174. A front tab member 179 is also provided to prevent a ball from rolling out of the V-shaped support 174. The rear tab member 180, as shown in FIG. 13A has a degree of curvature or inclination which is determinative of the curvature of the ball which is thrown from the V-shaped support 174. As shown in FIG. 13B, the rear tab 18*a* is positioned forward which would tend to reduce the arc of the ball exiting the V-shaped trough upon release of the cocking means 113 from the end 117*c* of the pitching arm. With the rear tab oriented as shown in FIG. 13A, the ball will be given a greater arc, i.e. higher, than would be achieved with the tab position as shown in FIG. 13B**.

Figure 13C:
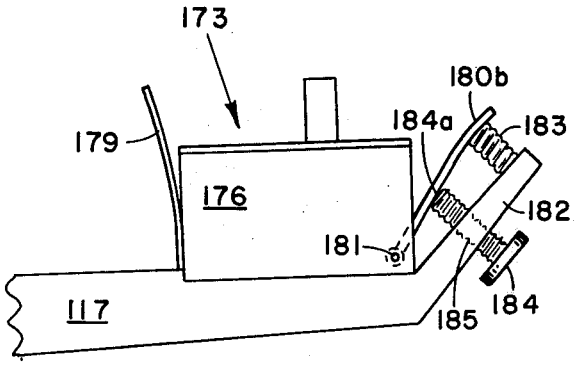
FIG. 13C is another partial view depicting the spring mechanism for the pitching arm.

FIG. 13C shows another embodiment of the ball support means, which includes components comparable to those of FIGS. 13A and 13B, which components have like reference numerals. FIG. 13C comprises a tab member **180*b*, which is pivotally mounted about a pin 181 which is secured with the plate members 175 and 176. A fixed arm member 182 is mounted on the arm 117 as shown in FIG. 13C and includes a spring 183 which is connected between the arm 182 and the tab 180*b*. A thumb screw 184 extends to a threaded opening 185 in the arm member 182 with its end 184*a* engaging the tab 180*b* due to the spring 183. As will be apparent, an adjustment of the thumb screw 184 will change the angle of inclination of the tab 180B which will affect the arc of the ball exiting the ball support means 173. The construction shown in FIG. 13C enables ready adjustment of the tab 180** without bending thereof which could result in failure of the tab after repeated bending.

While there has been shown and described a preferred embodiment of a ball pitching apparatus in accordance with the invention, it will be appreciated that many changes and modifications may be made therein without, however, departing from the essential spirit of the invention within the scope of the claims.

We claim:

1. A spring powered pitching arm for a ball pitching means for a ball pitching machine, comprising:

an oscillating pitching arm rotatably mounted upon a ball pitching machine for oscillating in a vertical arc;

a power drive means operatively connected with the pitching arm for pivoting the pitching arm one direction in the arc;

a selectively torsionable coil spring operatively connected with the pitching arm to impart a pitching force to the pitching arm upon torsioning of the coil spring by the movement in the one direction by the pitching arm and release of the pitching arm by the power drive means to allow the pitching arm to be moved in the opposite direction by the coil spring to provide the pitching motion;

a spring torsion adjusting means for setting the torsion of the coil spring to a prestressed first predetermined force value prior to additional torsioning of the coil spring by the movement in the said one direction by the pitching arm, said pitching arm applying the additional torsioning force to the coil spring resulting in a second greater predetermined stored force value in the coil spring to control the pitching force imparted to the pitching arm upon release by the drive means; and an adjustable link extending directly between and connecting the coil spring to the pitching arm to maintain the amount of torsion in the coil spring at the prestressed first predetermined force value prior to torsioning of the coil spring by the movement in the one direction by the pitching arm and at the end the arc of of the pitching arm to control the amount of pitching force imparted to the pitching arm.

2. The apparatus as set forth in claim 1, including:

a rotating pitching arm cocking means driven by the power drive means to engage and pivot the pitching arm in the one direction and torsion the coil spring to the second predetermined value which provides the pitching force applied to the pitching arm.

3. The apparatus as set forth in claim 1, wherein:

the spring torsion adjusting means including an adjustable lever arm to set the torsion of the coil spring to the first predetermined value prior to torsioning of the coil spring by the movement in said one direction by the pitching arm.

4. A spring powered pitching arm for a ball pitching means for a ball pitching machine, comprising:

an oscillating pitching arm rotatably mounted upon a ball pitching machine for oscillating in a vertical arc;

a power drive means operatively connected with the pitching arm for pivoting the pitching arm in one direction in the arc;

a selectively torsionable coil spring operatively connected with the pitching arm to impart a pitching force to the pitching arm upon torsioning of the coil spring by the movement in the one direction by the pitching arm and release of the pitching arm by the power drive means to allow the pitching arm to be moved in the opposite direction by the coil spring to provide the pitching motion;

a spring torsion adjusting means for setting the torsion of the coil spring to a prestressed first predetermined force value prior to additional torsioning of the coil spring by the movement in the said one direction by the pitching arm, said pitching arm applying the additional torsioning force to the coil spring resulting in a second greater predetermined stored force value in the coil spring to control the pitching force imparted to the pitching arm upon release by the drive means;

the spring torsion adjusting means including an adjustable lever arm to set the torsion of the coil spring to the first predetermined value prior to torsioning of the coil spring by the movement in one direction by the pitching arm; and a torsion adjusting bracket engaging the lever arm for controlling the position of the lever arm to maintain the torsion of the coil spring at the first predetermined value.

* * * * *